US005299434A

United States Patent [19]

Kaufman

[11] Patent Number: 5,299,434

[45] Date of Patent: Apr. 5, 1994

[54] SAFE-SEX BROOCH WITH PROPHYLACTIC HOLDER

[76] Inventor: Judith L. Kaufman, 20 E. 9th St., New York, N.Y. 10003

[21] Appl. No.: 905,382

[22] Filed: Jun. 29, 1992

[51] Int. Cl.[5] ..... A44C 13/00; A44C 25/00; A44C 15/00

[52] U.S. Cl. ..... 63/20; 63/1.1; 63/18; 63/2; 206/69

[58] Field of Search ..... 63/1.1, 2, 12, 18, 20; 206/69

[56] References Cited

U.S. PATENT DOCUMENTS

| | | | |
|---|---|---|---|
| 613,029 | 10/1898 | Fair | 63/20 |
| 2,118,639 | 5/1938 | Bayardi | 63/20 |
| 3,430,829 | 3/1969 | Wilson et al. | 40/1.5 |
| 4,422,306 | 12/1983 | Larson | 63/1.1 |
| 4,507,344 | 3/1985 | Baughman | 63/1.1 |
| 4,718,554 | 1/1988 | Barbato | 63/12 |
| 4,741,434 | 5/1988 | Liebman | 206/69 |
| 4,781,288 | 11/1988 | Wing | 206/69 |
| 4,805,820 | 2/1989 | Kearney et al. | 206/37 |
| 4,982,580 | 1/1991 | Otenbaker | 63/20 |
| 5,094,090 | 3/1992 | Bone | 63/20 |

FOREIGN PATENT DOCUMENTS

| | | | |
|---|---|---|---|
| 524993 | 5/1921 | France | 63/12 |

OTHER PUBLICATIONS

Newsweek, Mar. 28, 1988 p. 50.

*Primary Examiner*—Peter M. Cuomo
*Assistant Examiner*—Michael J. Milano
*Attorney, Agent, or Firm*—Edward T. Callahan

[57] ABSTRACT

A safe-sex device comprising an ornamental brooch that includes an emblem suggesting a message to a viewer that the wearer of the brooch carries a prophylactic against venereal infection, the emblem being positioned either inside or outside the clothing worn by the wearer. The brooch includes a clasp for removably attaching the emblem to the clothing. A packet having flexible foil walls containing the prophylactic, namely, a condom, is positioned in a packet holder that is removably mounted to the brooch located either behind the clothing out of sight of the viewer or external to the clothing behind the emblem. The packet holder has biasable holding walls that have a recess and a button that are located within the augmented borders of the condom, which is configured as a closed plane curve, so that the packet holder is removably gripped between the biasable holding walls.

5 Claims, 8 Drawing Sheets

SAFE-SEX BROOCH WITH PROPHYLACTIC HOLDER

FIELD OF THE INVENTION

This invention relates to a brooch having indicia for being secured to the clothing of a wearer including a rear mount for holding an object and more particularly the object being a prophylactic.

BACKGROUND OF THE INVENTION

Recent discoveries of sexually transmitted diseases, particularly AIDS and chlamydia, and the recent rise in the incidence of other venereal diseases, has raised public consciousness of the necessity of vigilance in taking health protective measures. At the same time, unmarried people wish to live as close to the social life they were used to prior to the recent upsurge in sexual diseases.

Women who wish to avoid pregnancy have used such self-armed measures as birth control pills and diaphragms, and, while such preventive means are effective against pregnancy, they are substantially ineffective against venereal diseases, including AIDS.

One of the proven ways to protect the health of both males and females from sexually transmitted disease is the use of prophylactic condoms by men during sexual intercourse. Women, therefore, have become more dependent upon the man to protect both of them against the transmission of disease by means of the use of the standard condom during sexual intercourse.

A health problem exists, however, because men often fail to carry a condom with them when they socialize, for example, at parties. Such social gatherings are important to young, unmarried people, but because of the prevalence of AIDS in particular, anxiety is created to the extent that often the idea of the occurrence of any sexual contact is rejected. More important, however, is the possibility that the woman may mistakenly believe that the man is going to use a condom, while the man mistakenly believes that the woman has taken precautions against inadvertent pregnancy and that such female precaution is sufficient to protect both of them without giving sufficient thought to protecting the woman, or for that matter, himself, from passage of a disease. The fact is, however, a man may carry a venereal infection without his knowledge.

SUMMARY OF THE INVENTION

It is therefore the object of the present invention to provide a safe-sex device that can be pinned to clothing and that includes facing ornamental indicia that serves as a statement that the wearer of the device carries a prophylactic condom.

It is therefore the object of the present invention to provide a safe-sex device that can be pinned to clothing and that includes facing ornamental indicia that serves as a statement that the wearer of the device is carrying a hidden packet containing a prophylactic condom.

It is therefore another object of the present invention to provide a safe-sex device that can be pinned to clothing and that carries indicia that serves as a statement in social situations that the device itself carries a packet containing an out-of-view prophylactic condom.

It is another object of the present invention to provide a safe-sex device that includes a brooch that has an ornamental face comprising indicia of safe sex and that further has a holding compartment that carries a sealed packet containing a single prophylactic positioned between the clothing and the ornamental face.

It is another object of the present invention to provide a safe-sex device that includes a brooch that has an ornamental face comprising indicia of safe sex and that further has a holding compartment that carries a sealed packet containing a single prophylactic positioned behind the clothing.

It is yet another object of the present device to provide a safe-sex device that includes a brooch that can be pinned to a woman's or a man's clothing, the brooch including both indicia of safe sex and a holding compartment that holds a packet containing a single condom hidden behind the clothing.

In accordance with these and other objects that will become apparent in the course of this disclosure, there is provided a safe-sex device comprising an ornamental brooch that includes an emblem suggesting a message to a viewer that the wearer of the brooch carries a prophylactic against venereal infection, the emblem being positioned either inside or outside clothing worn by the wearer. The brooch includes a clasp for removably attaching the emblem to the clothing. A packet having flexible foil walls containing the prophylactic, namely, a condom, is positioned in a packet holder that is removably mounted to the brooch and positioned either at the inner surface of the clothing or at the outer surface of the clothing directly behind the emblem. The packet holder has biasable holding walls that have a recess and a button that are located within the augmented borders of the condom, which is configured as a closed oval or circle, so that the packet is removably gripped between the recess and the button.

The present invention will be better understood and the objects and important features, other than those specifically set forth above, will become apparent when consideration is given to the following details and description, which when taken in conjunction with the annexed drawings, describes, discloses, illustrates, and shows preferred embodiments or modifications of the present invention and what is presently considered and believed to be the best mode of practice in the principles thereof.

A BRIEF STATEMENT OF THE FIGURES

DETAILED DESCRIPTION OF THE PREFERRED EMBODIMENT

Reference is now made in detail to the drawings wherein the same numerals refer to the same or similar elements throughout.

Figure 1:
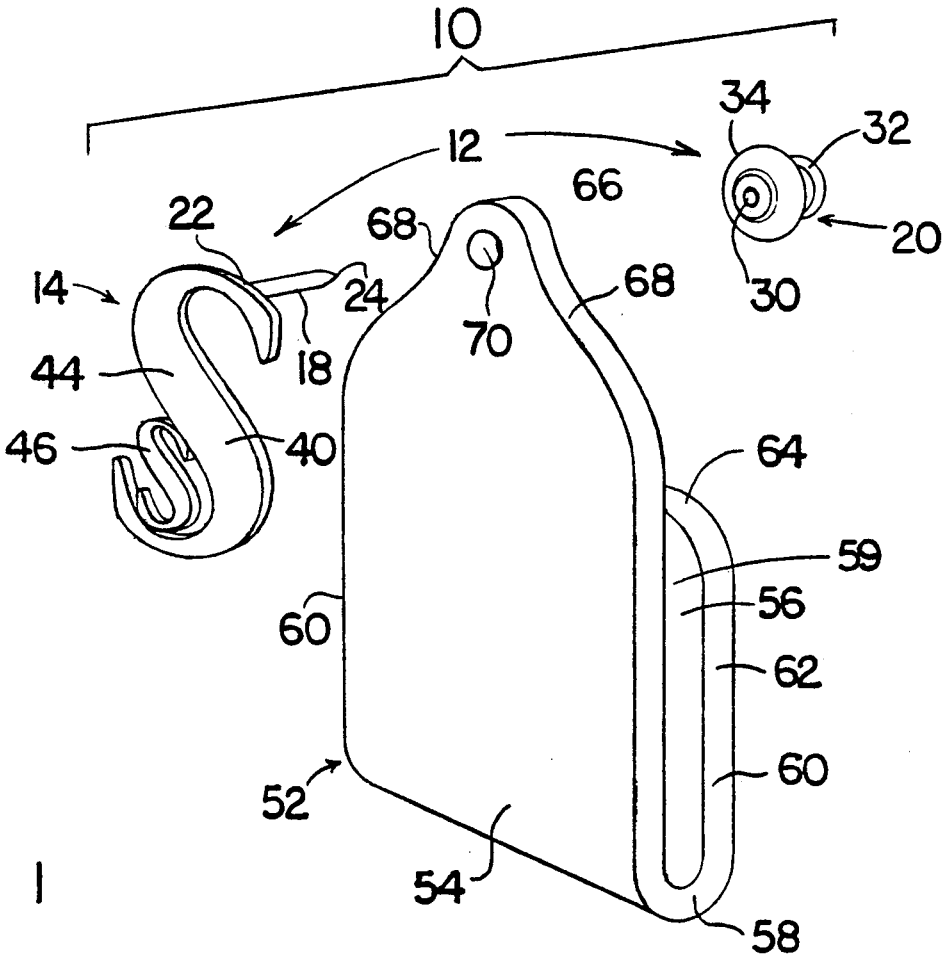
FIG. 1 is an exploded perspective view of the safe-sex device according to the present invention.
Figure 2:
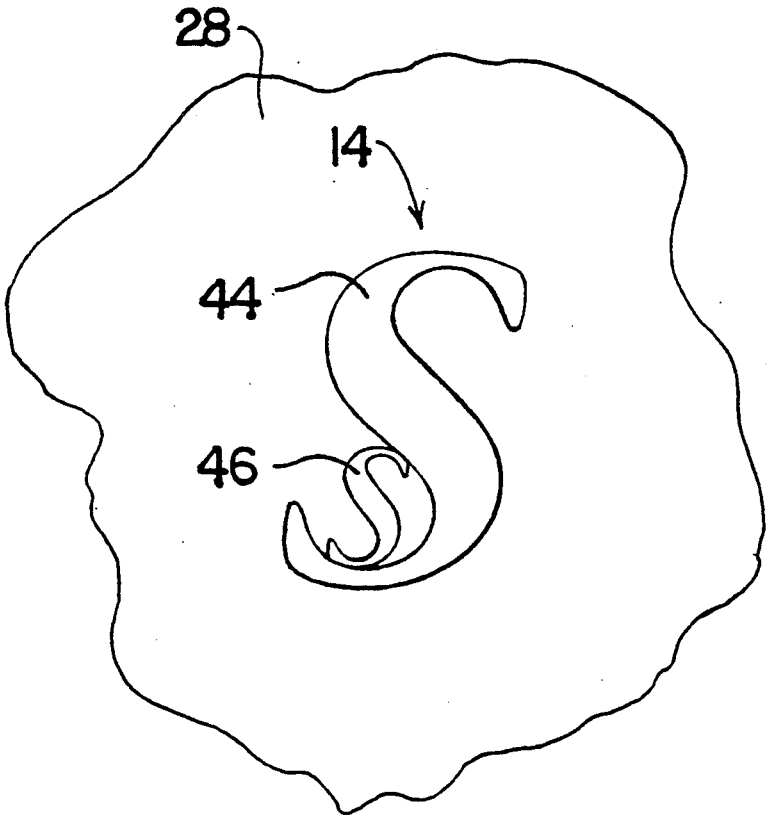
FIG. 2 is a frontal view of the brooch of the safe-sex device shown in FIG. 1 pinned to the clothing of a man or a woman.
Figure 3:
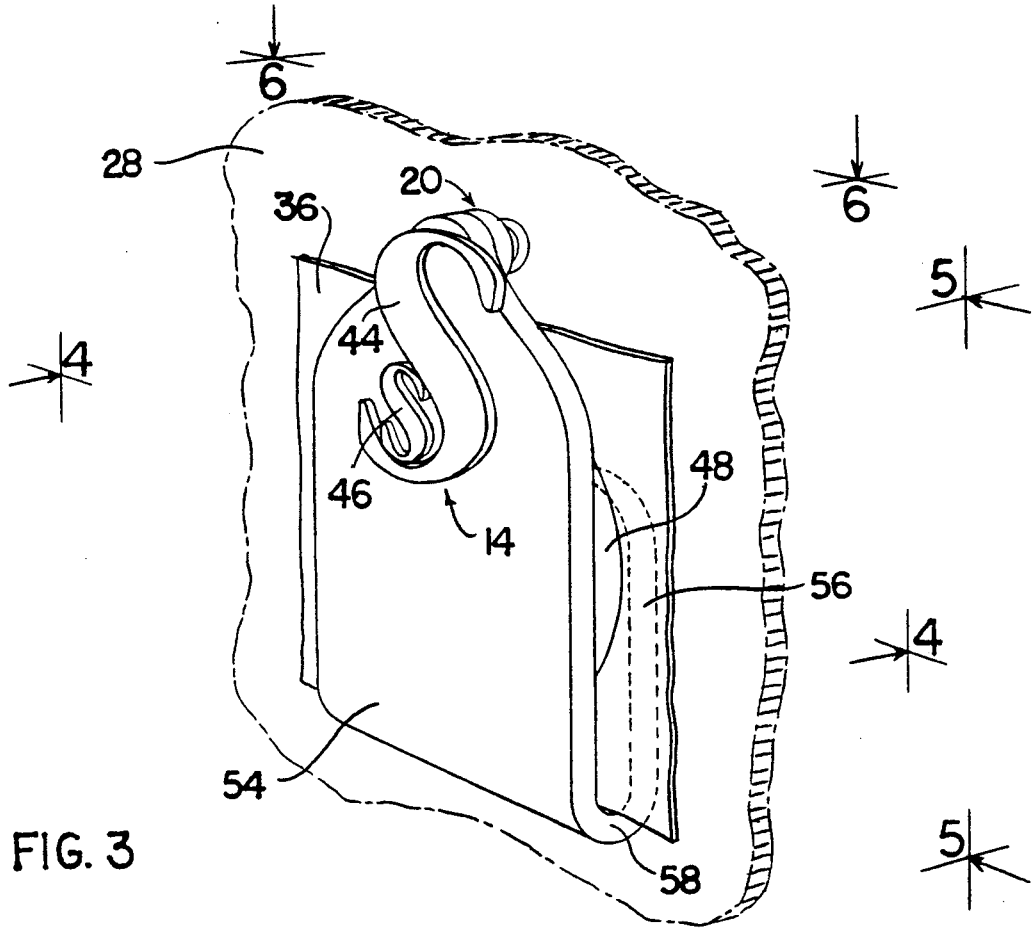
FIG. 3 is a perspective view of the safe-sex device mounted to clothing shown in phantom line and holding a sealed foil packet containing a single prophylactic condom.
Figure 4:
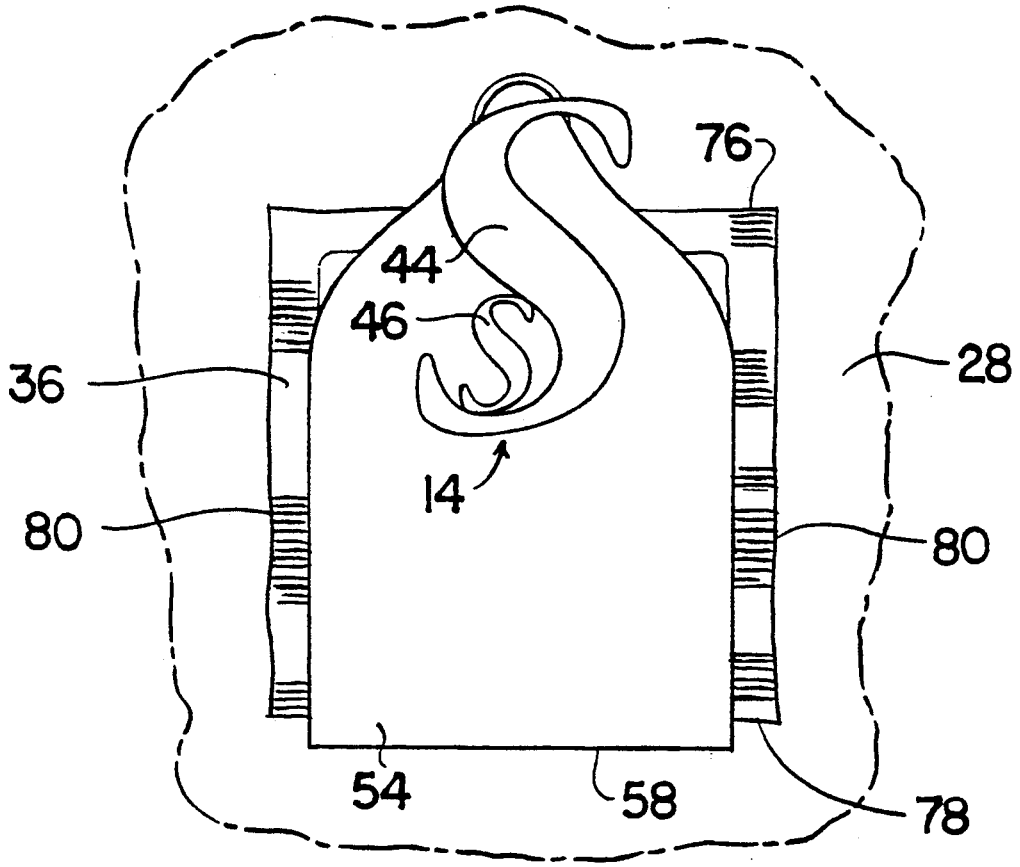
FIG. 4 is a frontal view taken through plane 4—4 of FIG. 3.
Figure 5:
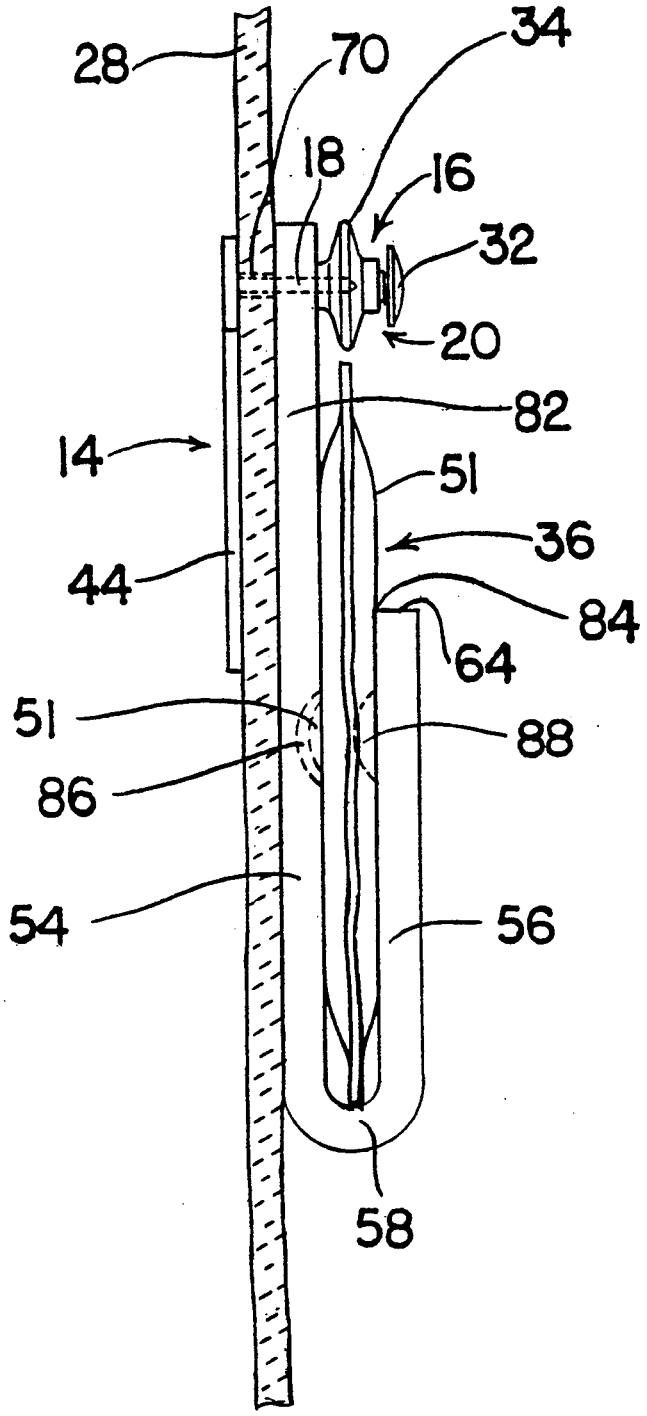
FIG. 5 is a side view taken through plane 5—5 of FIG. 3.

A safe-sex device 10 shown in FIGS. 1–7 includes an ornamental brooch 12, which includes an ornamental emblem 14 and a clasp 16, shown best in FIGS. 1 and 5, that includes a pin 18 and a pin grip 20. Pin 18 has opposed connecting and pointed ends 22 and 24, respectively, with connecting end 22 being attached to and extending rearward transversely from emblem 14. Pin grip 20 is releasably connected to pin 18 at pointed end 24 when pin 18 extends through the clothing 28 of the wearer of the clothing.

FIGS. 2–7 illustrate brooch 12 secured to clothing 28 by means of pin 18 extending transversely from emblem 14 through clothing 28 with pin end 24 extending into pin grip 20. Brooch 12 is secured to clothing 28 by passing pointed pin end 24 through clothing 28 into bore 30 of pin grip 20 until pin 18 is gripped within pin grip 20 by an internal gripping mechanism. Pin 18 is released from pin grip 20 by means of the wearer rotating a rearward releasing disk 32 while simultaneously holding a stationary forward disk 34, which is integral with pin grip 20, to prevent pin grip 20 from rotating as rear disk 32 is turned. Thus, brooch 12 is removably secured to clothing 28. Pin grip 20 is a gripping device that is known in the art of jewelry clasps.

Figure 7:
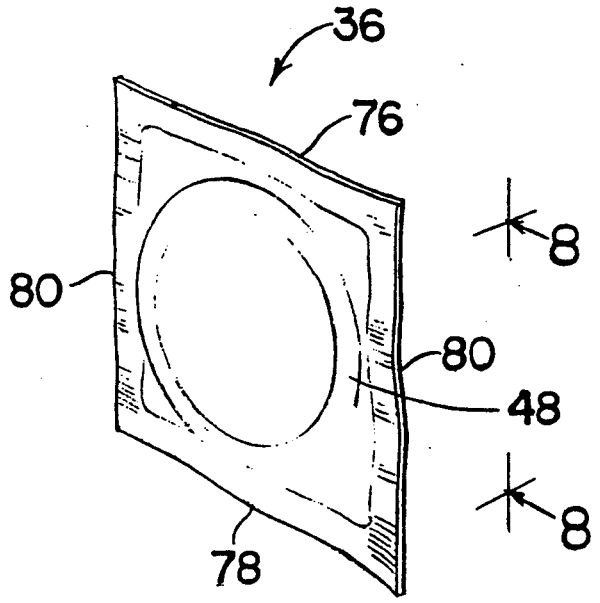
FIG. 7 is a perspective view of a foil packet containing a single prophylactic condom with the augmented borders of the condom coiled in a circular configuration.
Figure 8:
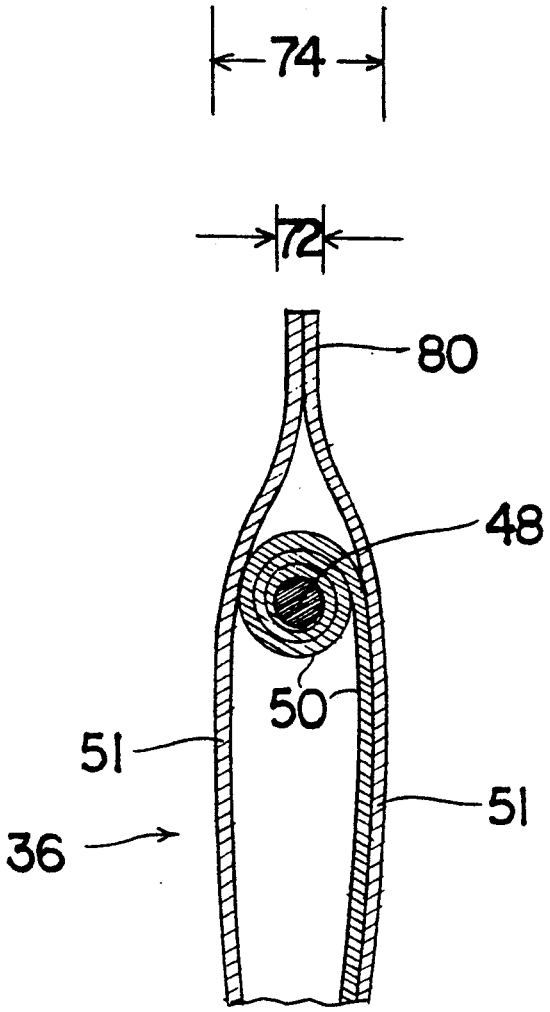
FIG. 8 is a view taken through plane 8—8 of FIG. 7.

Emblem 14, which is made of a rigid material such as metal or plastic, is flat having opposed facing and rear sides 40 and 42, respectively. Facing side 40 forms indicia shown as "SS" in an ornamental manner for being read by a viewer to whom it suggests a message, namely, "Safe Sex", that the wearer of brooch 12 carries a packet 36 containing a prophylactic device against venereal infection, namely, a condom 38. The indicia SS are arranged with a large S 44 with a small S 46 positioned within and connected to the lower curve of large S 44. The outline of the augmented borders 48 and the sheath 50 of condom 38 is indicated in FIGS. 7 and 8 coiled in a circular configuration proximate the outer edges of packet 36 that presses outwardly from the foil seal 51 from which packet 36 is made. Emblem 14 is positioned outside clothing 28 worn by the wearer. Pin 18 is affixed to rear side 42 of emblem 14.

Safe-sex device 10 includes a packet holder 52 that supports packet 36. Packet holder 52 has opposed spaced front and rear walls 54 and 56 and a bottom wall 58 connected to front and outer walls 54 and 56 defining a holding compartment 59, in which packet 36 is positioned. Front wall 54 has opposed parallel side edges 60, and rear wall 56 has opposed side edges 62 aligned with side edges 60, each side edge 60 and 62 being transverse to bottom wall 58. Rear wall 56 has a top edge 64 that is lateral to bottom wall 58 and transverse to side edges 60 and 62. Front wall 54 has a narrow centered top side 66 that is spaced beyond top edge 64 and also has slanted side edges 68 that angle inwardly from side edges 60 to top side 66. A hole 70 extends through front wall 54 spaced proximate to top side 66. Thus, brooch 12 can be mounted to clothing 28 by passing pin 18 through clothing 28 and through hole 70 into bore 30 of pin grip 20; or brooch 12 can be removed from clothing 28 by releasing pin 18 from pin grip 20 and pulling pin 18 from bore 30 and through hole 70 and through clothing 2B. Packet holder 52 is positioned at the inner surface of clothing 28 out of sight of the viewer when brooch 12 is mounted to clothing 28.

Front wall 54 of packet holder 52 is positioned proximate to and spaced from rear side 42 of emblem 14 with clothing 28 positioned between front wall 54 and emblem 14. Pin grip 20 is in contact with front wall inner surface 82 of front wall 54.

Figure 6:
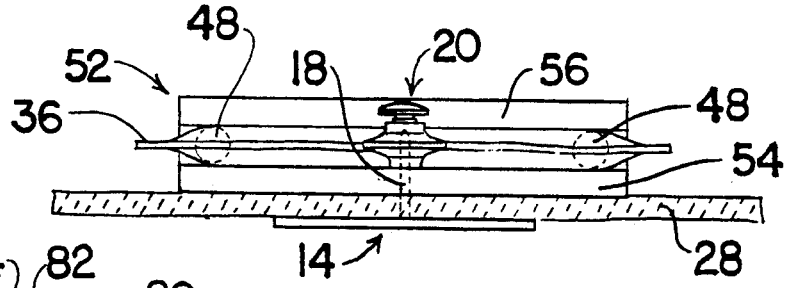
FIG. 6 is a top view taken through plane 6—6 of FIG. 3.
Figure 5A:
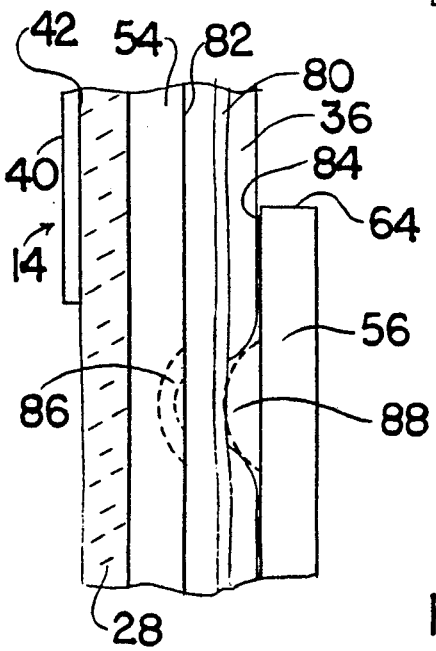
FIG. 5A is a detail view of the button and recess of the packet holder taken from the view of FIG. 5.

As shown in FIGS. 7 and 8, packet 36 is relatively flat with a first dimension having a first thickness 72 sufficient to contain the sheath portion of the condom and a second thickness 74 slightly greater than first thickness 72 and slightly greater than augmented borders 48 of condom 38, as also shown in section in FIGS. 5, 5A, and 6. The other two dimensions of packet 36 include parallel upper and lower edges 76 and 78, respectively, and opposed parallel side edges 80 transverse to upper and lower edges 74 and 76, thus forming a rectangular configuration, in particular a square configuration.

Packet 36 is positioned within holding compartment 59 with first and second thicknesses 72 and 74 of packet 36 extending between front and rear walls 54 and 56. Packet holder 52 is made of a resilient material and rear wall 56 is rotatable relative to front wall 54 along bottom wall 58 between biased and unbiased modes, the unbiased mode being when rear wall 56 is spaced from front wall 54 at a first distance and the biased mode being when said front wall 54 is spaced from front wall 54 at a second distance greater than the first distance.

Front wall 54 and rear wall 56 of packet holder 52 have an opposed front wall inner surface and a rear wall inner surface 82 and 84, respectively. A cavity 86 is defined by front wall 54 at inner surface 82 and a raised semi-cylindrical portion, or button, 88 connected to rear wall 56 extending from inner surface 8 is positioned opposite cavity 86. Both cavity 86 and button 88 are centrally positioned relative to front and rear wall inner and outer surfaces 82 and 84. Packet 36 is made of a flexible material such as a metal foil and coiled augmented border 48 is configured as a closed plane curve, namely, a circle. Cavity 86 and button 88 are positioned within the closed plane curve of augmented border 48 when packet 36 is positioned within holding compartment 59, so that button 88 presses at least a portion of packet 36 within augmented border 48 into cavity 86, so that packet 36 is gripped by packet holder 52 with rear wall 56 in its unbiased mode thus preventing packet 36 from falling from packet holder 59 until rear wall 56 is forced into its biased mode.

Packet 36 as described herein is described as square to accommodate condom 38, which has a circular augmented border 48. The present invention can be used to grip a packet having edges of different dimensions or configurations or both. Also, the augmented border of the condom can be configured other than augmented border 48, for example, the augmented border of the condom could be configured as an oval.

Figure 9:
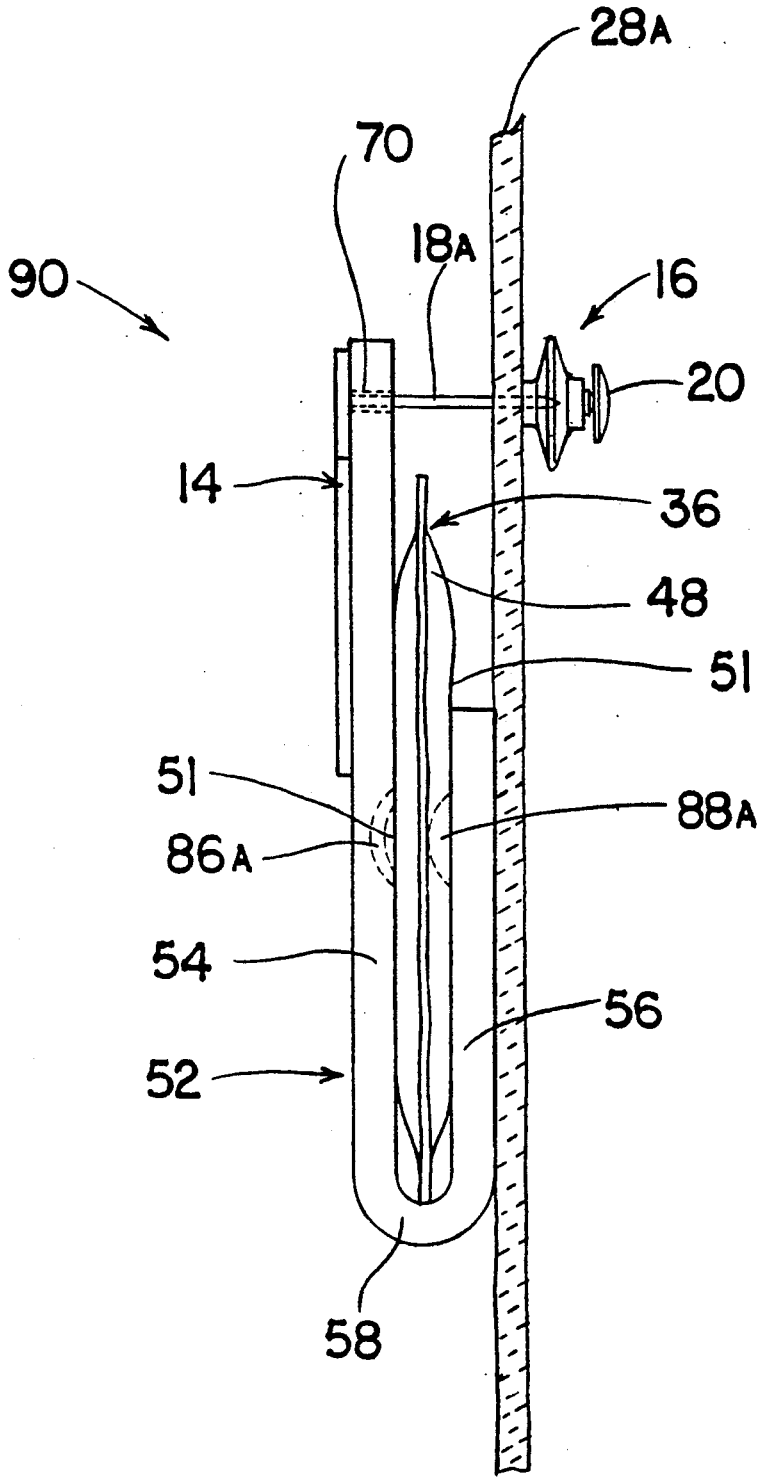
FIG. 9 is a side view of a safe-sex device with a packet holder positioned directly behind the emblem outside the clothing.

FIG. 9 illustrates safe-sex device 90 analogous to safe-sex device 10 in a side view analogous to the side view of FIG. 5. In this embodiment, packet holder 52 is located external to clothing 28 directly behind emblem 14, and clothing 28A is located between packet holder 52 and pin grip 20 having a pin 18A. In FIG. 9, front wall 54 has a button 88A and rear wall 56 defines a cavity 86A opposed to button 88A. Button 88A and cavity 86A are located within the augmented border 48 of packet 36.

Although the present system has been described in some detail by way of illustration and example for purposes of clarity and understanding, it will, of course, be understood that various changes and modifications may be made in the form, details, and arrangements of the parts without departing from the scope of the invention set forth in the following claims.

What is claimed is:

1. A safe-sex device, comprising, in combination, an ornamental brooch, said brooch including an emblem, said brooch further including securing means for removably attaching said emblem to clothing of a user, said securing means including a pin having opposed connecting and pointed ends, said connecting end being attached to said emblem, and further including a pin grip releasably connected to said pin at said pointed end, and holding means for supporting a prophylactic, said holding means being removably mounted to said brooch, whereby said holding means can be positioned either inside or outside the clothing, said holding means being a holding member having opposed front and rear walls and a bottom wall connected to said inner and outer walls, said front and rear walls and said bottom wall defining a holding space, the prophylactic being positioned in said holding space, said front wall of said holding member defining a hole, said pin extending through said hole, said holding member being positioned between said emblem and said pin grip, said holding member being made of a resilient material and said rear wall being rotatable relative to said front wall at said bottom wall between biased and unbiased modes, said unbiased mode being when said rear wall is spaced from said front wall at a first distance, and said biased mode being when said rear wall is spaced from said front wall at a second distance greater than said first distance, wherein the prophylactic is gripped between said front and rear walls in said unbiased mode, said inner and outer walls of said holding member having opposed inner and outer wall surfaces, respectively, one of said inner and outer wall surfaces defining a cavity and the other of said inner and outer wall surfaces having a raised portion positioned opposed to said cavity, said cavity and raised portion being centrally located relative to said inner and outer wall surfaces, respectively, the prophylactic being contained in a packet made of a flexible material, the prophylactic being a condom having coiled augmented borders configured as a closed plane curve, said raised portion and said cavity being positioned within the closed plane curve when the packet is mounted to said holding member, a portion of the packet being located in said cavity and held in a gripping relationship with said raised portion when said holding member is in the unbiased mode.

2. The device according to claim 1, wherein said pin grip is a clutch.

3. A safe-sex device, comprising, in combination, an ornamental brooch, said brooch including an emblem, said brooch further including securing means for removably attaching said emblem to material, holding means for supporting a prophylactic, said holding means including a holding member having opposed front and rear walls and a bottom wall connected to said front and rear walls, said front and rear walls and said bottom wall defining a holding space, said prophylactic being positioned in said holding space, said front wall being connected to said brooch, said holding member being made of a resilient material and said rear wall being rotatable relative to said front wall at said bottom wall between biased and unbiased modes, said unbiased mode being when said rear wall is spaced from said front wall at a first distance, and said biased mode being when said rear wall is spaced from said front wall at a second distance greater than said first distance, wherein the prophylactic is gripped between said front and rear walls in said unbiased mode, said front and rear walls of said holding member having opposed inner and outer wall surfaces, respectively, one of said inner and outer wall surfaces defining a cavity and the other of said inner and outer wall surfaces having a raised portion positioned opposed to said cavity, said cavity and raised portion being centrally located relative to said inner and outer wall surfaces, respectively, the prophylactic being contained in a packet made of a flexible material, the prophylactic being a condom having coiled augmented borders configured as a closed plane curve, said raised portion and said cavity being positioned within the closed plane curve when the packet is mounted to said holding member, a portion of the packet being located in said cavity and held in a gripping relationship with said raised portion when said holding member is in the unbiased mode.

4. The device according to claim 3, wherein said securing means includes a pin having opposed connecting and pointed ends, said connecting end being attached to said rear side of said emblematic means, and further includes a pin grip releasably connected to said pin at said pointed end, said front wall of said holding member defining a hole, said pin extending through said hole, said holding member being removably positioned between said emblem and said pin grip.

5. A device for holding a prophylactic, comprising, a holding member having opposed front and rear walls and a bottom wall connected to said front and rear walls, said front and rear walls and said bottom wall defining a holding space, said front wall being connected to said brooch, the prophylactic being positioned in said holding space, said holding member being made of a resilient material and said rear wall being rotatable relative to said front wall at said bottom wall between biased and unbiased modes, said unbiased mode being when said rear wall is spaced from said front wall at a first distance, and said biased mode being when said rear wall is spaced from said front wall at a second distance greater than said first distance, wherein the prophylactic is gripped between said front and rear walls in said unbiased mode, said front and rear walls of said holding member having opposed inner and outer wall surfaces, respectively, one of said inner and outer wall surfaces defining a cavity and the other of said inner and outer wall surfaces having a raised portion positioned opposed to said cavity, said cavity and raised portion being centrally located relative to said inner and outer wall surfaces, respectively, the prophylactic being contained in a packet made of a flexible material, the prophylactic being a condom having coiled augmented borders configured as a closed plane curve, said raised portion and said cavity being positioned within the closed plane curve when the packet is mounted to said holding member, a portion of the packet being located in said cavity and held in a gripping relationship with said raised portion when said holding member is in the unbiased mode.

* * * * *